US006575554B2

(12) United States Patent
Yoshinaga

(10) Patent No.: US 6,575,554 B2
(45) Date of Patent: Jun. 10, 2003

(54) INK JET RECORDING APPARATUS

(75) Inventor: Kenji Yoshinaga, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/968,895

(22) Filed: Oct. 3, 2001

(65) Prior Publication Data

US 2002/0041303 A1 Apr. 11, 2002

(30) Foreign Application Priority Data

Oct. 10, 2000 (JP) ..... 2000-309177
Sep. 21, 2001 (JP) ..... 2001-289056

(51) Int. Cl.[7] ..... B41J 2/165
(52) U.S. Cl. ..... 347/22; 347/35
(58) Field of Search ..... 347/22, 25, 30, 347/34–36, 48

(56) References Cited

U.S. PATENT DOCUMENTS 6,224,191 B1 * 5/2001 Saito et al. ..... 347/48
6,347,858 B1 * 2/2002 Fasst, Jr. et al. ..... 347/22
6,352,333 B1 * 3/2002 Matsumoto et al. ..... 347/23

* cited by examiner

*Primary Examiner*—John Barlow
*Assistant Examiner*—An H. Do
(74) *Attorney, Agent, or Firm*—Fitzpatrick, Cella, Harper & Scinto

(57) ABSTRACT

An ink jet recording apparatus is provided which can perform high-quality recording without causing a backside smear of a recording medium even in frameless recording where an image is recorded in full size until reaching lengthwise and widthwise ends of the recording medium. In an ink jet recording apparatus for ejecting ink from an ink jet recording head to a recording medium to record an image, the apparatus includes a platen for supporting the recording medium in a position opposed to the ink jet recording head, an ink recovery section for recovering ink ejected outside an end of the recording medium, a common negative pressure chamber for generating a pressure in the ink recovery section lower than the atmospheric pressure, and an air stream passage for communicating the ink recovery section and the common negative pressure chamber with each other.

27 Claims, 10 Drawing Sheets

INK JET RECORDING APPARATUS

BACKGROUND OF THE INVENTION

1. Field of the Invention

The present invention relates to an ink jet recording apparatus for recording an image by ejecting ink onto a recording medium. More particularly, the present invention relates to an ink jet recording apparatus for use in information processing equipment such as printers, copying machines, computers, and word processors.

2. Description of the Related Art

As one of conventional recording apparatuses, an ink jet recording apparatus is known in which a recording medium is intermittently fed in a recording section, and each time the feed is interrupted, ink droplets are ejected from a recording head over a certain width in a direction perpendicular to the feed direction, thereby recording an image.

In an ink jet recording apparatus, unless the spacing between a nozzle surface of a recording head, which ejects ink in a recording section, and a recording medium is maintained to be very small with high accuracy, there occur a deflection of an image due to an arrival failure of ejected ink droplets, and a smear due to contact between the recording head and the recording medium.

In some of ink jet recording apparatuses, therefore, a carriage holding a recording head is scanned with high accuracy using a guide shaft of good straightness, and a recording medium is attracted onto a flat platen under a vacuum sucking action. Generally, in the apparatus using such a sucking platen, a vacuum pump, a fan or the like is employed as a negative pressure generating source, and air in an enclosed space below the platen is evacuated to the outside to create a negative pressure in the space.

Recently, to meet a demand for recording an image in the frameless form without surrounding margins as with a borderless photograph, there has been proposed an apparatus in which ink is ejected over a range greater than the width of a recording medium to form a frameless image.

FIG. 9 is a perspective view of a platen and thereabout of such a conventional recording apparatus. Referring to FIG. 9, a recording medium 201 is supplied to a recording section in the apparatus from the direction of arrow K. A feed roller 202 is able to grip the recording medium 201 in cooperation with pinch rollers 203, 204 and 205, and to intermittently feed the recording medium 201 with high accuracy through coupling to a driving system (not shown) that rotates the feed roller.

A platen 206 is arranged such that its guide surface 206*a* supports thereon the recording medium 201 fed to the platen 206 by the feed roller 202 in a surface-to-surface contact relation. A plurality of openings 210 are formed in the guide surface 206*a* and communicated with a space formed within the platen 206 via air passages. When the space formed in the platen 206 below the guide surface 206*a* is evacuated to create a negative pressure by a vacuum pump or a fan, the recording medium 201 is attracted onto the guide surface 206*a* of the platen 206 through the openings 210 under a vacuum sucking action. Thus, the recording medium 201 can maintain a certain level of planeness.

A guide shaft 231 is arranged such that its axis extends in a direction, perpendicular to the feed direction of the recording medium 201 and parallel to the guide surface 206*a* of the platen 206.

A carriage 232 is fitted over the guide shaft 231 and coupled to a linearly moving means (not shown) for movement in directions of arrows L and L', i.e., in the main scan direction. An ink jet recording head is provided in the carriage 232 and has an ink ejection surface positioned to face the guide surface 206*a* of the platen 206. During the movement of the recording head in the main scan direction, the spacing between the ink ejection surface and the recording medium 201 is maintained with high accuracy as long as the recording medium 201 is attracted onto the platen 206 to take a satisfactory flat posture.

The carriage 232 receives an electrical signal from a main control unit via a cable (not shown) and transmits the received signal to the recording head for ejecting ink. In accordance with the ejection signal received during the movement in the main scan direction, the recording head forms a long strip of image on the recording medium 201 lying over the platen 206 with a width corresponding to a row of ejection nozzles provided in the recording head. By repeating the above recording step the predetermined number of times whenever the recording medium 201 is intermittently fed by the feed roller 202, an image of one page can be formed on the recording medium 201.

The plurality of circular openings 210 formed in the guide surface 206*a* of the platen 206 are arrayed at an appropriate pitch so that the recording medium 201 is stably attracted onto the platen 206 through the plurality of openings 210 under vacuum suction. Further, ink recovery ports 211, 212 for frameless recording are formed in the platen 206 at positions respectively corresponding to both ends 201*a*, 201*b* of the recording medium 201 in the width direction thereof. Ink ejected outside the width of the recording medium 201 is recovered through the ink recovery ports 211, 212 to prevent the ink from directly depositing on the guide surface 206*a* of the platen 206.

FIG. 10 is a sectional view for explaining a situation in which the recording head ejects ink near the widthwise end 201*a* of the recording medium 201 in the frameless recording. Because the ends 201*a* of the recording medium 201 projects like a pent roof, there occurs an air eddy as indicated by one-dot-chain lines.

The conventional recording apparatus described above, therefore, has the following problems. The occurrence of an air eddy causes ink to scatter in the form of mists in addition to main ink droplets ejected from the recording head. The scattered mists may deposit on the backside of the recording medium and give rise to a backside smear.

Also, such ink mists move in a floating condition with the movement of the scanned carriage. When the recording medium 201 sometimes rises, even though slightly, away from the platen 206, the ink mists are attracted to the left, as viewed in FIG. 10, by sucking forces acting through the suction openings 210 and deposit on the platen surface adjacent to the ink recovery port 211. Then, the deposited ink mists adhere to the backside of the recording medium and also gives rise to a backside smear even slightly.

Further, when a leading end of the recording medium is positioned above the ink recovery port at the initial point of recording operation of one image, ink mists occur at the same time as ink ejection from the recording head and go around the leading end of the recording medium, thereby disturbing air streams. That tendency increases and intensifies turbulence as the recording medium is fed with the progress of recording and covers the ink recovery port at a greater rate. As a result, the ink mists may deposit on the backside of the leading end of the recording medium and give rise to a backside smear at the leading end of the recording medium.

Moreover, the recording head performs preliminary ejection for ejecting ink, which resides in nozzles and has an increased viscosity, before starting to eject the ink onto the recording medium. The ink is ejected in the preliminary ejection toward an ink receiver having the same structure as the ink recovery port. Upon the preliminary ejection, an air eddy occurs around an ejected ink stream due to air resistance and reaction caused within the ink receiver. This leads to a possibility that the ink may scatter to the surroundings of the ink receiver and give rise to a smear.

In addition, the ink mists and the ejected ink tend to deposit at corners of wall surfaces of both the ink recovery port and the ink receiver due to a capillary phenomenon, and gradually grow with the repeated recording operation to such an extent as impeding air streams in the ink recovery port and the ink receiver. Therefore, unwanted ink, such as ink mists, may scatter and deposit on the backside of the recording medium, thereby causing a backside smear.

SUMMARY OF THE INVENTION

In view of the state of the art set forth above, it is an object of the present invention to provide an ink jet recording apparatus which can perform high-quality recording without causing a backside smear of a recording medium even in frameless recording where an image is recorded in full size until reaching lengthwise and widthwise ends of the recording medium with respect the feed direction.

Another object of the present invention is to provide an ink jet recording apparatus which can prevent ink from scattering when preliminary ejection is performed.

Still another object of the present invention is to provide an ink jet recording apparatus which has a stream baffling structure provided corresponding to each of opposite ends of a recording medium to prevent the occurrence of turbulence caused in an ink sucking recovery port when the ends of the recording medium are subjected to an ink jet recording, and hence which can avoid ink mists from going around to the backside of the recording medium.

Still another object of the present invention is to provide an ink jet recording apparatus for ejecting ink from a recording unit to a recording medium to record an image, the apparatus comprising an ink recovery section for recovering ink ejected outside an end of the recording medium, a negative pressure generating unit for generating a pressure in the ink recovery section lower than the atmospheric pressure, and an air stream passage for communicating the ink recovery section and the negative pressure generating unit with each other.

Further objects, features and advantages of the present invention will become apparent from the following description of the preferred embodiments with reference to the attached drawings.

DESCRIPTION OF THE PREFERRED EMBODIMENTS

Embodiments of the present invention will be described below with reference to the drawings.

(First Embodiment)

Figure 1:
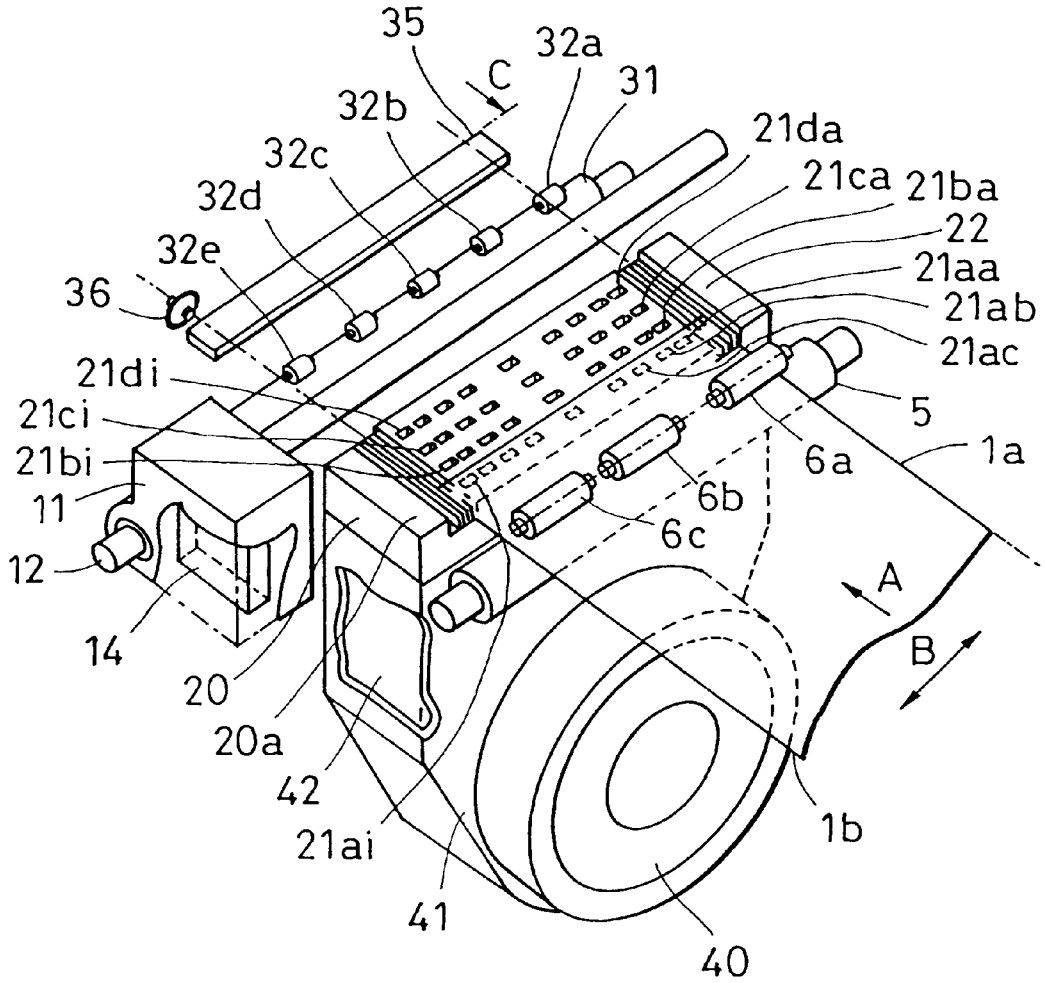
FIG. 1 is a perspective view of a platen and thereabout of an ink jet recording apparatus according to a first embodiment of the present invention.

A first embodiment of the present invention will be described with reference to FIGS. 1 to 3. FIG. 1 is a perspective view of a platen and thereabout of an ink jet recording apparatus according to a first embodiment of the present invention.

A recording medium 1 led out a roll of paper is supplied by a feed means (not shown) in the direction of arrow A toward a recording section. A feed roller 5 grips the recording medium 1 supplied in the direction of arrow A in cooperation with pinch rollers 6*a,* 6*b* and 6*c,* and intermittently feeds the recording medium 1 with high accuracy at a pitch corresponding to a predetermined amount of movement per feed.

A platen 20 has a guide surface 20*a* substantially flush with the nips between the feed roller 5 and the pinch rollers 6*a,* 6*b* and 6*c*. To maintain the distance between a nozzle surface of an ink jet recording head 14, described later, and the recording medium 1 with high accuracy, the platen surface 20*a* supports thereon the recording medium 1 in a surface-to-surface contact relation with good planeness. A plurality of guide-surface side openings 21 are formed in the guide surface 20*a* of the platen 20, which contacts the recording medium 1. Further, an ink recovery section 22 for recovering ink ejected from the ink jet recording head 14 is provided in the platen 20 at a position corresponding to each of opposite ends of the recording medium 1 in the width direction thereof.

Below the guide surface 20*a* of the platen 20, side walls of the platen defines a space that serves as a common negative pressure chamber 42. The common negative pressure chamber 42 is coupled to a fan case 41 while being enclosed with respect to the outside. The ink recovery section 22 and the fan case 41 accommodating a fan 40 therein are communicated with each other through an inner space of the common negative pressure chamber 42. The common negative pressure chamber 42 interposed between the ink recovery section 22 and the fan case 41 is herein called a communicating portion. In another structure wherein the ink recovery section 22 and the fan case 41 are directly coupled to each other, an opening through which air flows from the ink recovery section 22 to the fan case 41 is called a coupling portion. With rotation of the fan 40, air in the common negative pressure chamber 42 is evacuated to the outside so that a negative pressure can be created in the common negative pressure chamber 42.

A carriage 11 is slidably supported by a guide shaft 12 extending in the width direction of the recording medium 1. The carriage 11 is coupled to a linearly moving means (not shown) and is able to move in the axial direction of the guide shaft 12 in accordance with a command from a control unit.

The ink jet recording head 14 is mounted on the carriage 11 and electrically connected to the control unit via a connecting cable (not shown) for control of ink ejection. A row of nozzles having a width W is arranged in a lower surface of the ink jet recording head 14, which faces the platen 20, to extend in a direction transverse to the main scan direction. The row of nozzles is able to eject ink droplets downwards as viewed in FIG. 1, and to record an image having a maximum width W per main scan on the recording medium 1.

An ink cartridge (not shown) containing ink is also held on the carriage 11 to be movable together with the carriage 11. The ink cartridge is connected to the ink jet recording head 14 for supplying the ink to it.

During the recording, the recording medium 1 is intermittently fed by the feed roller 5. The leading end position of the recording medium 1 is moved at a predetermined pitch. Whenever each intermittent feed is ended, the ink jet recording head 14 is moved in the main scan direction together with the carriage 11 to form a strip of image having a predetermined width on the recording medium 1.

A let-out roller 31 and auxiliary rollers 32*a* to 32*e* are rotated in sync with the intermittent driving of the feed roller 5 to prevent the recording medium 1 from rising away from the platen 20 or skewing. Gripping forces developed between the let-out roller 31 and the auxiliary rollers 32*a* to 32*e* are set to be weaker than those developed between the feed roller 5 and the pinch rollers 6*a*, 6*b*, 6*c*. Because of such setting, the accuracy of intermittent feed in the recording section is predominately governed by the feed action developed between the feed roller 5 and the pinch rollers 6*a*, 6*b*, 6*c*.

A cutter lower blade 35 is extended in the width direction of the recording medium 1 and is disposed substantially flush with the nips between the let-out roller 31 and the auxiliary rollers 32*a* to 32*e* downstream of those rollers in the feed direction. A roller cutter edge 36 is coupled to a linearly driving mechanism (not shown) to be movable in the width direction of the recording medium 1 while contacting the cutter lower blade 35.

The recording medium 1 having completed the recording of an image of one page is advanced by the feed roller 5 and the pinch rollers 6*a*, 6*b*, 6*c* to such an extent that a preset cut position on the recording medium 1 reaches a cutting position C in FIG. 1. Then, the recording medium 1 is cut with the movement of the roller cutter edge 36 and is ejected to the outside of the apparatus by other rollers, etc. disposed on the further downstream side in the feed direction.

Figure 2:
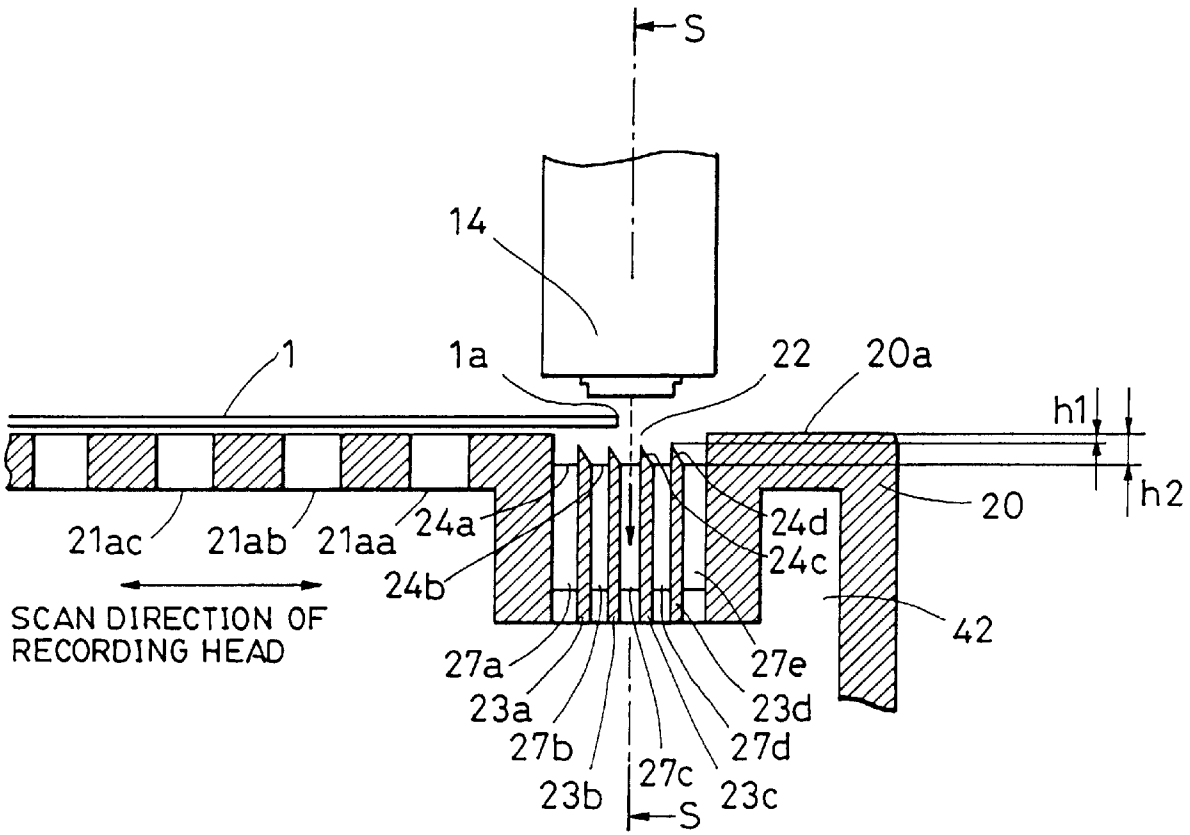
FIG. 2 is a sectional view of the platen sectioned in the width direction of a recording medium.

FIG. 2 is a sectional view of the platen 20 sectioned in the width direction of the recording medium 1 in an area around a position corresponding to one widthwise end 1*a* of the recording medium 1. An ink recovery section 22 for recovering the ink ejected from the ink jet recording head 14 is provided at the position corresponding to the widthwise end 1*a* of the recording medium 1. The ink recovery section 22 includes thin plates 23*a*, 23*b*, 23*c* and 23*d* arranged therein side by side substantially parallel to the direction of ink ejection from the ink jet recording head 14. Air is able to flow into respective spaces between the thin plates 23, and those spaces constitute air stream passages 27*a*, 27*b*, 27*c*, 27*d* and 27*e* which are communicated with the common negative pressure chamber 42. The height of an uppermost end of each thin plate 23 is set to be h1 lower than the guide surface 20*a* of the platen 20. Upper end portions of the thin plates 23 have respective sloped surfaces 24*a*, 24*b*, 24*c*, 24*d* formed such that the upper end portions gradually thin toward the uppermost ends and act to reduce the occurrence of turbulence when air flows into the ink recovery section 22 from above. Each sloped surface 24 is formed on the side of thin plate 23 where ink droplets ejected from the ink jet recording head 14 and striking against the sloped surface 24 are reflected in a direction away from the recording medium 1.

Figure 3:
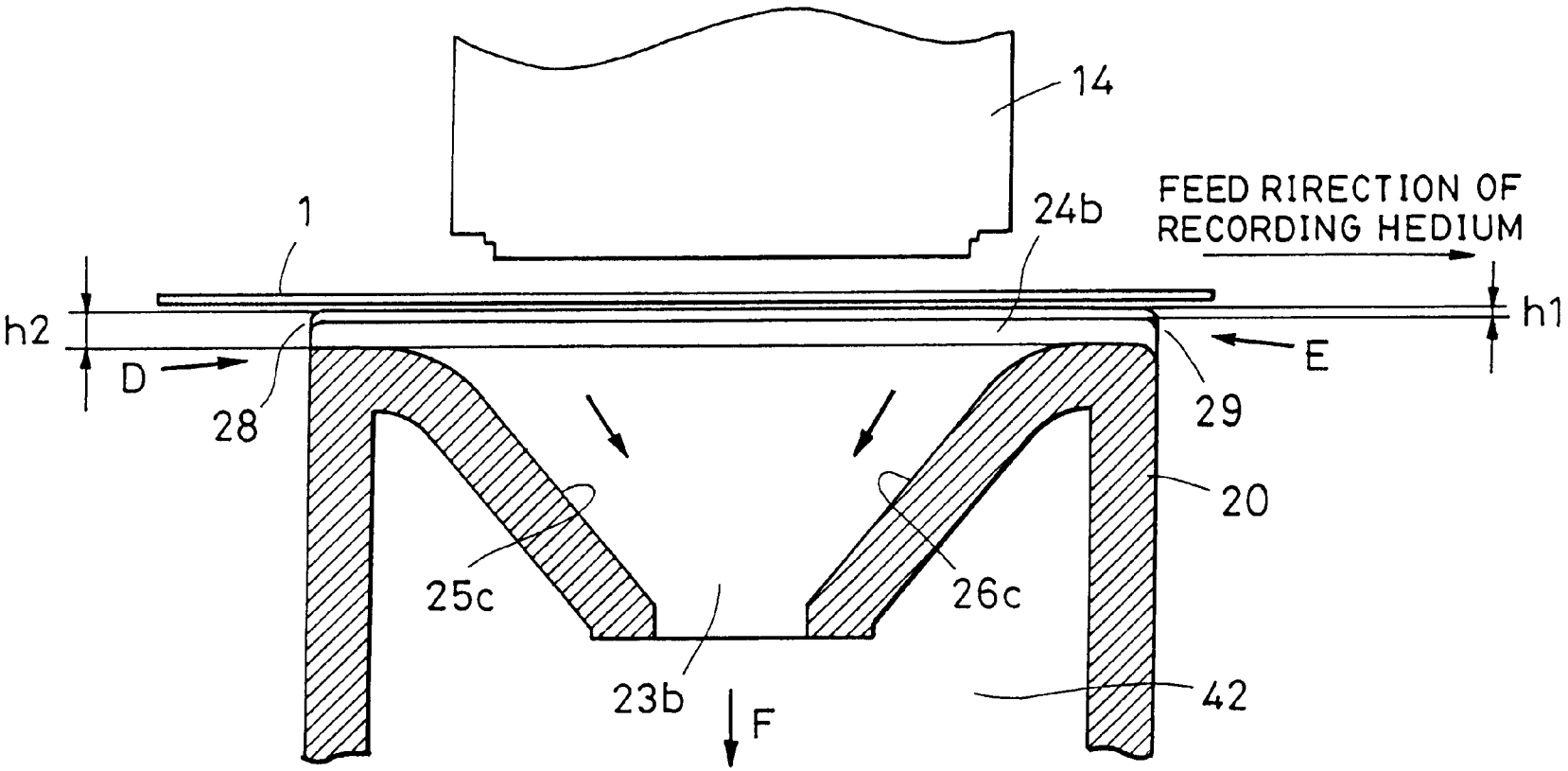
FIG. 3 is a sectional view taken along the line III—III in FIG. 2.

FIG. 3 is a sectional view taken along the line III—III in FIG. 2. At the position corresponding to each of the widthwise ends of the recording medium 1, inflow ports 28, 29 allowing air to flow into the ink recovery section 22 through them are formed at opposite ends of the platen 20 in the feed direction of the recording medium 1 such that the inflow ports 28, 29 are recessed by h2 from the guide surface 20*a*. The inflow ports 28, 29 are continuously joined to sloped surfaces 25*c*, 26*c* that are formed so as to gradually narrow the spacing therebetween in the feed direction of the recording medium 1 as they come closer to the lower ends. In such a wall structure, a space defined between the sloped surfaces 25*c*, 26*c* is communicated at its lower end with the common negative pressure chamber 42. Air is allowed to flow into the space through the inflow ports 28, 29 in the directions of arrows D and E, and then flows out in the direction of arrow F after joining with air having flown into the space from above. The other air flow passages 27*b*, 27*c*, 27*d* and 27*e* formed between the other thin plates 23 are each of the same configuration as described above. The ink recovery section 22 provided on the side corresponding to the other end 1*b* of the recording medium 1 also has a similar structure.

The above-described wall structure develops a stream baffling action based on the following reasons. A plurality of air stream passages are formed in a close side-by-side relation substantially parallel to each other to define a portion of a flow path extending from the air inlet side facing the ink jet recording head 14 to the common negative pressure chamber 42, and the length of each air stream passage in the direction of air stream is set to be greater than the length of at least one side of an opening section of each air stream passage on the air inlet side (i.e., the length of the opening section in the width direction of the recording medium 1 in FIG. 2). Hence, there is no spatial allowance causing an air eddy to occur.

Further, since the height of the uppermost end of each thin plate 23 is set to be h1 lower than the guide surface 20*a* of the platen 20, the ink deposited on the uppermost end of the thin plate 23 is prevented from contacting the backside of the recording medium 1. Although smaller h1 is more effective in preventing the occurrence of an air eddy, a proper practical value of h1 is set in consideration of a fall of the recording medium 1 due to its own weight and curling. From experimental results, the value of h1 is preferably not larger than 1 mm. It is also preferable that the thin plates 23 are formed integrally with the platen 20 for improved dimensional stability.

The operation of the ink jet recording apparatus will be described below.

When the fan 40 starts rotation, air in the common negative pressure chamber 42 is evacuated to the outside and a negative pressure is created in the common negative pressure chamber 42. The recording medium 1 fed to the guide surface 20*a* of the platen 20 is attracted onto it by vacuum suction through the guide-surface side openings 21 so that the recording medium 1 maintains desired planeness.

As shown in FIG. 2, when the recording medium 1 is fed to the guide surface 20*a* of the platen 20, the air stream passages 27*c*, 27*d* and 27*e* develop the stream baffling action upon air flowing into the ink recovery section 22, and therefore an air eddy is prevented from occurring in upper portions of those air stream passages. Also, an area above the air stream passages 27*a,* 27*b* is covered by the recording medium 1, but air flows into the ink recovery section 22 through the inflow ports 28, 29 and then smoothly flows along the sloped surfaces 25, 26. Hence, there occurs no air eddy.

With the construction described above, when an image is formed on the recording medium 1 by frameless recording, ink is ejected from the ink jet recording head 14 that is moved outwards beyond each widthwise end of the recording medium 1. On that occasion, since air streams near the widthwise end of the recording medium 1 are straightly guided, main ink droplets ejected from the ink jet recording head 14 and associated ink mists are recovered through the air stream passage 27*c* between the thin plates 23*b,* 23*c* and then sucked into the common negative pressure chamber 42. As a result, the ink is prevented from depositing on the backside of the recording medium 1 and hence from causing a backside smear.

It is not always required to provide the thin plate 23 in plural number. The stream baffling action can be developed so long as a plurality of air stream passages are formed in a close side-by-side relation substantially parallel to each other to define a portion of a flow path extending from the air inlet side facing the ink jet recording head 14 to the common negative pressure chamber 42, and the length of each air stream passage in the direction of air stream is set to be greater than the length of at least one side of an opening section of each air stream passage on the air inlet side (i.e., the length of the opening section in the width direction of the recording medium 1 in FIG. 2), whereby there is no spatial allowance causing an air eddy to occur.

In other words, an ink jet recording apparatus can be provided which has a stream baffling structure provided corresponding to each of opposite ends of a recording medium to prevent the occurrence of turbulence caused in an ink sucking recovery port when the ends of the recording medium are subjected to an ink jet recording, and hence which can avoid ink mists from going around to the backside of the recording medium.

Further, the ejected ink droplets and ink mists flow into the air stream passages together with the air streams and deposit on wall surfaces of the air stream passages. The deposited ink droplets and ink mists move along those wall surfaces in the direction of gravity, but tend to accumulate at corners in section of each air stream passage due to a capillary phenomenon. By providing an ink absorber in contact with lower ends of those wall surfaces, therefore, it is possible to prevent the accumulated ink droplets and ink mists from impeding the air streams in the air stream passages. Also, it is possible to prevent the accumulated ink droplets and ink mists from rising along the wall surfaces due to a capillary phenomenon and hence from staining the backside of the recording medium 1.

(Second Embodiment)

A second embodiment of the present invention will be described with reference to FIG. 4. The second embodiment is constructed to be adaptable for frameless recording on the recording media of various sizes.

Figure 4:
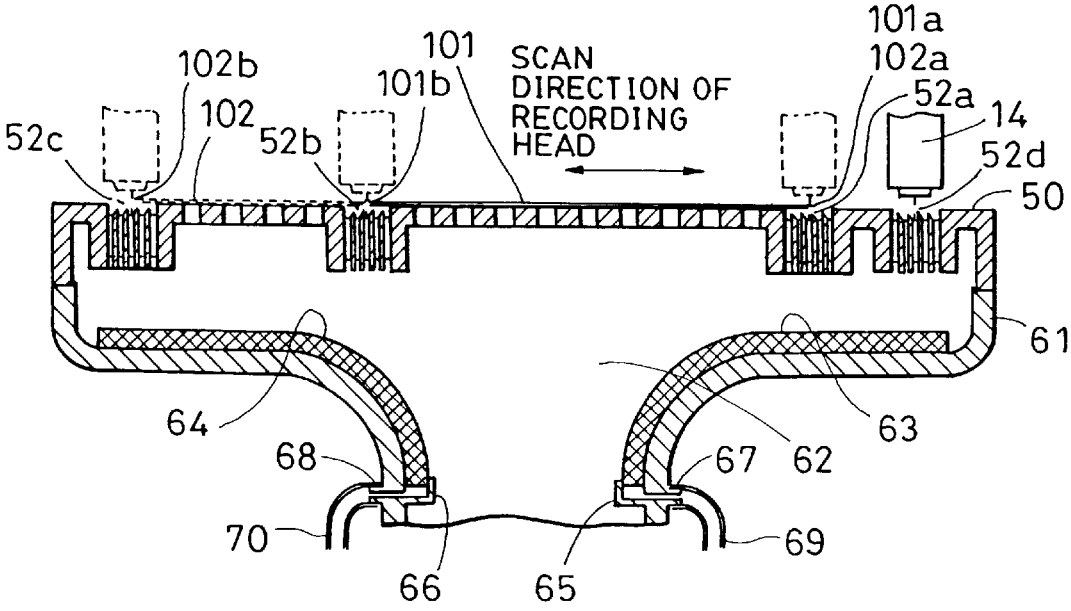
FIG. 4 is a sectional view of an ink jet recording apparatus according to a second embodiment of the present invention.

FIG. 4 is a sectional view of an ink jet recording apparatus according to a second embodiment of the present invention. The second embodiment enables the frameless recording to be made on a recording medium 101 of a small size and a recording medium 102 of a large size. One end of the recording medium 101 of a small size locates at the same position as one end of the recording medium 102 of a large size. Four ink recovery sections 52 are formed in a platen 50. Specifically, ink recovery sections 52*a,* 52*b* are formed at positions corresponding to both ends of the recording medium 101 of a small size, and an ink recovery section 52*c* is formed at a position corresponding to the other end of the recording medium 102 of a large size. An ink recovery section 52*d* is formed at a preliminary ejection position where ink is preliminarily ejected from the ink jet recording head 14 prior to the start of recording operation.

A duct 61 is joined to the bottom side of the platen 50, and has a lower end coupled to a fan (not shown). A space surrounded by the platen 50 and the duct 61 serves as a common negative pressure chamber 62. With rotation of the fan, a negative pressure relative to the atmospheric pressure is formed in the common negative pressure chamber 62. Each recording medium 101, 102 is attracted by vacuum suction through a plurality of negative-surface side openings formed in a guide surface of the platen 50, and air flows into the common negative pressure chamber 62 from above each of the ink recovery sections 52.

Ink absorbers 63, 64 capable of absorbing a liquid, such as ink, are disposed on inner walls of the duct 61 to lie below the ink recovery sections 52, and absorb ink droplets and ink mists dropping through the ink recovery sections 52. Ink receivers 65, 66 are provided at lowermost ends of the ink absorbers 63, 64. The ink receivers 65, 66 receive the ink flowing out of the ink absorbers 63, 64 after being absorbed in the ink absorbers 63, 64 up to a certain amount, and temporarily store the ink therein. Through holes 67, 68 are formed in respective side walls of the ink receivers 65, 66 to discharge the ink temporarily stored therein. The discharged ink is introduced through tubes 69, 70 to a reservoir tank (not shown) provided outside the duct 61.

The operation of frameless recording made on the recording medium 101 or 102 will be described below.

First, the recording medium 101 or 102 is fed to the platen 50 and attracted onto the guide surface of the platen 50 upon operation of the sucking fan (not shown). A negative pressure is formed within the common negative pressure chamber 62, and there occur air streams flowing from above the ink recovery sections 52 into the common negative pressure chamber 62.

Then, the ink jet recording head 14 is moved from a standby position to start scan for recording an image of the first line. In the course of the scan, the ink jet recording head 14 performs preliminary ejection when it reaches a position corresponding to the ink recovery section 52*d* that is provided at the preliminary ejection position. In a conventional apparatus, when ink is preliminarily ejected toward a preliminary ejection section provided near a platen, an air eddy is generated around an ejected ink stream, thus causing the ink to scatter to the surroundings. By contrast, when ink is ejected toward the ink recovery section 52*d* in this embodiment, the ejected ink is guided to straightly pass the ink recovery section 52*d* and then absorbed by the ink absorber 63 without causing no air eddy.

When the ink jet recording head 14 reaches a position immediately before one end 101*a* or 102*a* of the recording medium 101 or 102 during the scan, ink ejection for forming an image is started. The ink ejected from the ink jet recording head 14 immediately before the one end of the recording medium is absorbed by the ink absorber 63 after having passed the ink recovery section 52*a*.

Ink ejection for one scan is completed when the ink jet recording head 14 reaches a position slightly outwards beyond the other end 101*b* or 102*b* of the recording medium 101 or 102 in each line where recording is to be made during that scan. The ink ejected from the ink jet recording head 14 having moved beyond the other end of the recording medium is absorbed by the ink absorber 64 after having passed the ink recovery section 52*b* or 52*c*.

With this embodiment having the above-described construction, even in an ink jet recording apparatus for recording an image on recording media of various sizes, since the ink recovery sections are provided in the platen at positions corresponding to both widthwise ends of the recording medium of each size, it is possible to prevent a backside smear of the recording medium and to achieve high-quality recording. Also, since the ink absorber is disposed below the ink recovery section, ink droplets and ink mists can be prevented from depositing on the sucking fan and from causing an operation failure, and ink mists are prevented from passing the fan and being dissipated to the outside of the apparatus. Further, the ink absorbed by the ink absorber can be drained to the outside of the duct and recovered separately. Accordingly, the ink absorber is prevented from being saturated with ink, and hence can maintain an ink absorbing capability.

(Third Embodiment)

Figure 5A:
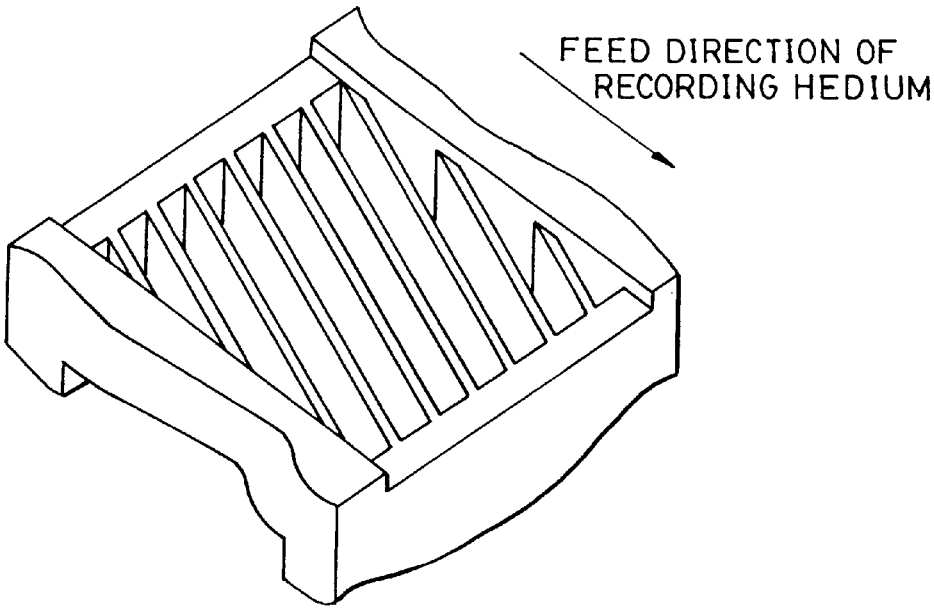
FIGS. 5A and 5B are each a perspective view for explaining an ink recovery section according to a third embodiment of the present invention.

A third embodiment of the present invention will be described below with reference to FIGS. 5A and 5B. FIG. 5A is a perspective view showing another example of the ink recovery section according to the third embodiment.

In this third embodiment, the thin plates are provided side by side obliquely with respect to the row of nozzles of the ink jet recording head 14. This arrangement eliminates a possibility that, at certain timing, the ink ejected through one row of nozzles of the ink jet recording head 14 may hit against the top of one thin plate in a concentrated manner. Therefore, more stability of air streams can be achieved.

The thin plates for forming the air stream passages are not always required to be arranged parallel to each other. The thin plates can develop the stream baffling action so long as the length of each air stream passage in the direction of air stream is set to be greater than the length of at least one side of an opening section of each air stream passage on the air inlet side of the ink recovery section.

Figure 5B:
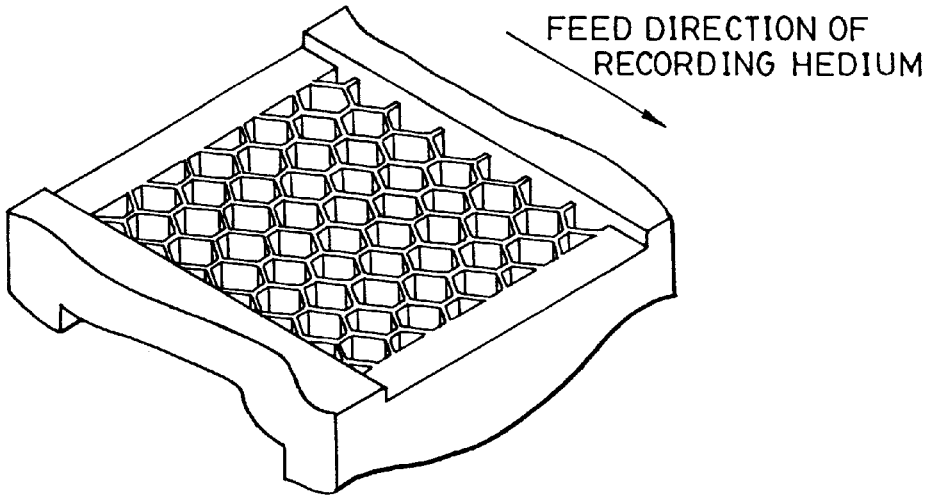

As an alternative, the thin plates may be arranged in the form of a grid or in the honeycomb structure, as shown in FIG. 5B, for the purpose of increasing the strength of a unit including the thin plates.

Further, the ejected ink droplets and ink mists flow into the air stream passages together with air streams and partly deposit on wall surfaces of the air stream passages. The deposited ink droplets and ink mists move along those wall surfaces in the direction of gravity, but tend to accumulate at corners in section of each air stream passage due to a capillary phenomenon. By providing an ink absorber in contact with lower ends of those wall surfaces, therefore, the accumulated ink droplets and ink mists can be prevented from impeding the air streams flowing through the air stream passages. Also, it is possible to prevent the accumulated ink droplets and ink mists from rising along the wall surfaces due to a capillary phenomenon and hence from staining the backside of the recording medium.

(Fourth Embodiment)

Figure 6:
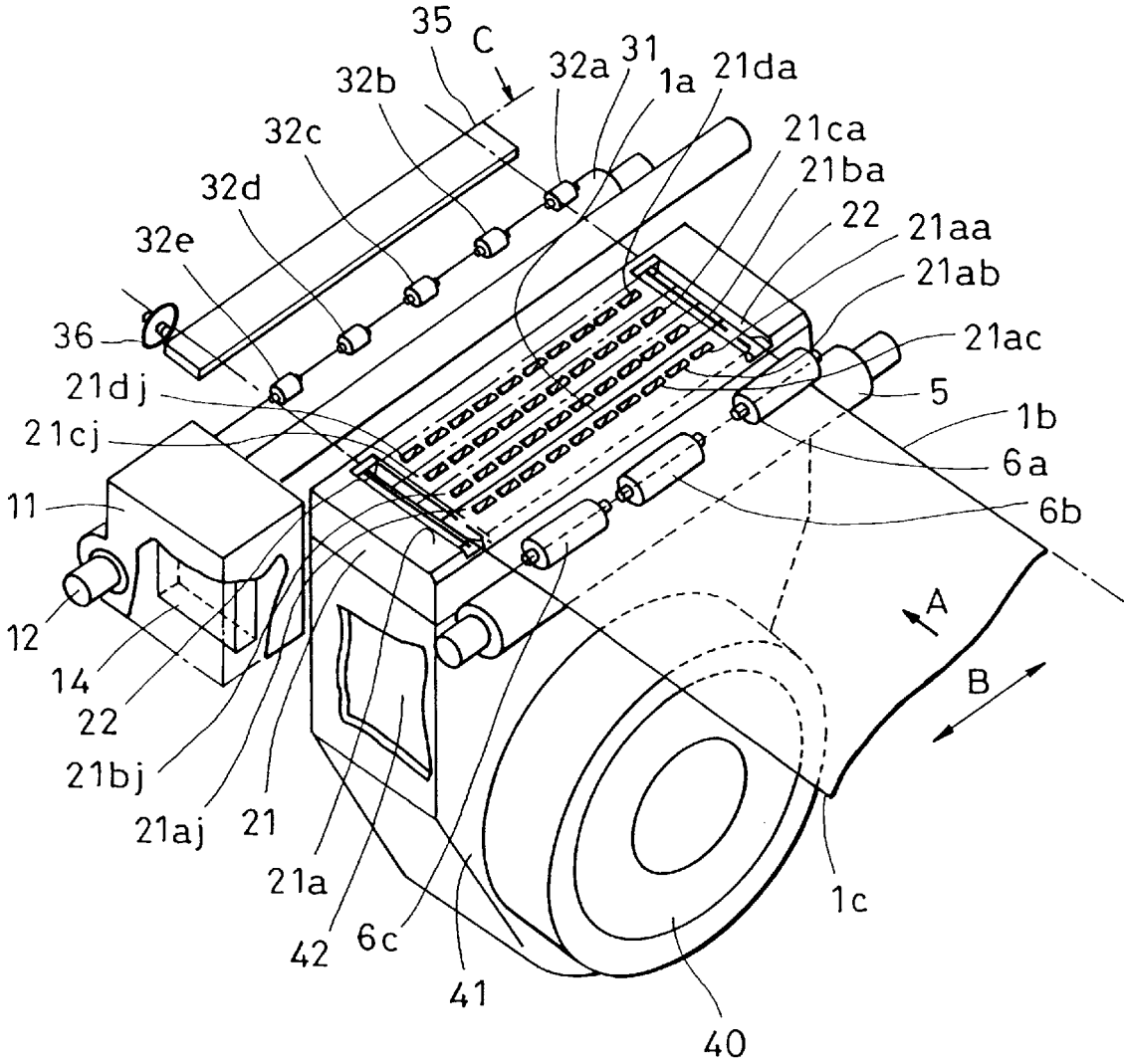
FIG. 6 is a perspective view of a platen and thereabout of an ink jet recording apparatus according to a fourth embodiment of the present invention.

A fourth embodiment of the present invention will be described with reference to FIGS. 6 to 8. FIG. 6 is a perspective view of a platen and thereabout of an ink jet recording apparatus according to a fourth embodiment of the present invention. The ink jet recording apparatus of this fourth embodiment shown in FIG. 6 is the same as that of the first embodiment shown in FIG. 1 except for the structure of the ink recovery section 22. Therefore, a detailed description of other components than the ink recovery section 22 is omitted here. The ink recovery section 22 in this embodiment will be described below with reference to FIGS. 7 and 8.

Figure 7:
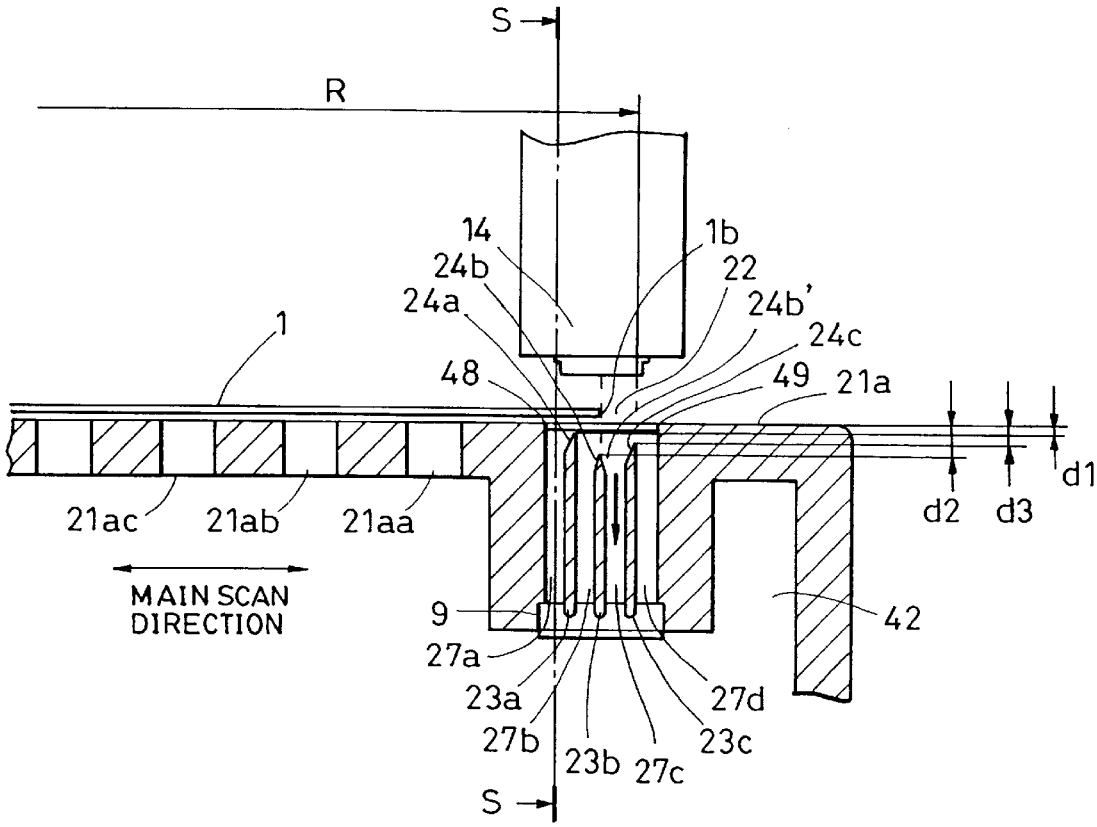
FIG. 7 is a sectional view of the platen, shown in FIG. 6, sectioned in the width direction of a recording medium.

FIG. 7 is a sectional view of the platen 20, shown in FIG. 6, sectioned in the width direction of the recording medium 1 in an area around a position corresponding to one end 1*b* of the recording medium 1 in the widthwise direction thereof. The ink recovery section 22 for recovering the ink ejected from the ink jet recording head 14 is provided at the position corresponding to the widthwise end 1*b* of the recording medium 1. The ink recovery section 22 includes thin plates 23*a*, 23*b* and 23*c* arranged therein side by side substantially parallel to the direction of ink ejection from the ink jet recording head 14. Air is able to flow into respective spaces between the thin plates 23, and those spaces constitute air stream passages 27*a*, 27*b*, 27*c* and 27*d* which are communicated with the common negative pressure chamber 42. Respective positions of the thin plates 23*a*, 23*b* and 23*c* are set as follows. The thin plate 23*a* is always positioned nearer to the central side of the recording medium 1 (the left side as viewed in FIG. 7) with respect to the position at which the end 1*b* of the recording medium 1 passes when it is fed. The thin plate 23*b* is positioned almost just below the position at which the end 1*b* of the recording medium 1 passes when it is fed. The thin plate 23*c* is positioned almost just below the end position of an ejection area R to which the ink jet recording head 14 is moved outwards beyond the end 1*b* of the recording medium 1 for frameless recording.

The height of an uppermost end of the thin plate 23*a* is set to be d1 lower than the guide surface 20*a* of the platen 20. Likewise, the heights of uppermost ends of the thin plate 23*b*, 23*c* are set respectively to be d2, d3 lower than the guide surface 20*a* of the platen 20. Among d1, d2 and d3, d1 is minimum and set to be as small as possible within a range not causing contact between the uppermost end of the thin plate 23*a* and the recording medium 1. Thus, it is desired that resistance be given to an air stream passing a gap between a lower surface of the recording medium 1 and the uppermost end of the thin plate 23*a*. Then, d3 is second minimum and d2 is slightly larger than d3. An upper end portion of the thin plate 23*a* has a sloped surface 24*a* on one side facing toward the central side of the recording medium 1 and also has a vertical surface substantially parallel to the direction of ink ejection on the opposite side. Such a shape of the upper end portion of the thin plate 23*a* serves to give resistance to an air stream passing the gap between the lower surface of the recording medium 1 and the uppermost end of the thin plate 23*a* from the left to the right, as viewed in FIG. 7, for the purpose of preventing ink mists from moving beyond the uppermost end of the thin plate 23*a* and then scattering to a left edge 48 of the platen 20.

An upper end portion of the thin plate 23*b* has sloped surfaces 24*b*, 24*b*′ on both front and rear sides in the thickness direction of the thin plate. That shape of the upper end portion of the thin plate 23*b* is intended to allow the ejected ink having passed by the end 1*b* of the recording medium 1 to more easily flow into any of the air stream passages 27*b*, 27*c* even when the end 1*b* of the recording medium 1 is displaced to the left or the right as viewed in FIG. 7.

An upper end portion of the thin plate 23*c* has a sloped surface 24*c* facing toward the central side of the recording medium 1. When the ink ejected and passed laterally of the end 1*b* of the recording medium 1 hits against the thin plate 23*c*, the sloped surface 24*c* enables the ejected ink and mists to more easily flow into the air stream passage 27*c* and hence prevent them from scattering to a right edge 49 of the platen 20.

With the construction described above, when the recording medium 1 sometimes abruptly rises, even though slightly, away from the platen 20, the air and ink mist above the ink recovery section 22 are attracted to the left, as viewed in FIG. 7, by sucking forces acting through the suction openings 21. However, because of increased resistance against air inflow beyond the uppermost end of the thin plate 23*a,* the ink mist generated upon the ink being ejected outside the end 1*b* of the recording medium 1 is hard to move beyond the uppermost end of the thin plate 23*a*. Even if a part of the ink mist moves beyond the uppermost end of the thin plate 23*a,* it comes across the air stream passage 27*a* for recovering ink where almost all of the ink mist is caused to flow in the specific direction of sucking developed within the ink recovery section 22. Also, the ink ejected outside the end 1*b* of the recording medium 1 is guided by the sloped surfaces 24*b'*, 24*c* of the upper end portions of the thin plates 23*b,* 23*c* to more easily flow into the air stream passage 27*c*. Even if a part of the ink mist moves beyond the uppermost end of the thin plate 23*c* and scatters to the right as viewed in FIG. 7, it comes across the air stream passage 27*d* for recovering ink where almost all of the ink mist is caused to flow in the specific direction of sucking developed within the ink recovery section 22. Accordingly, the ink mist can be prevented from staining the right edge 49 of the platen 20.

Figure 8:
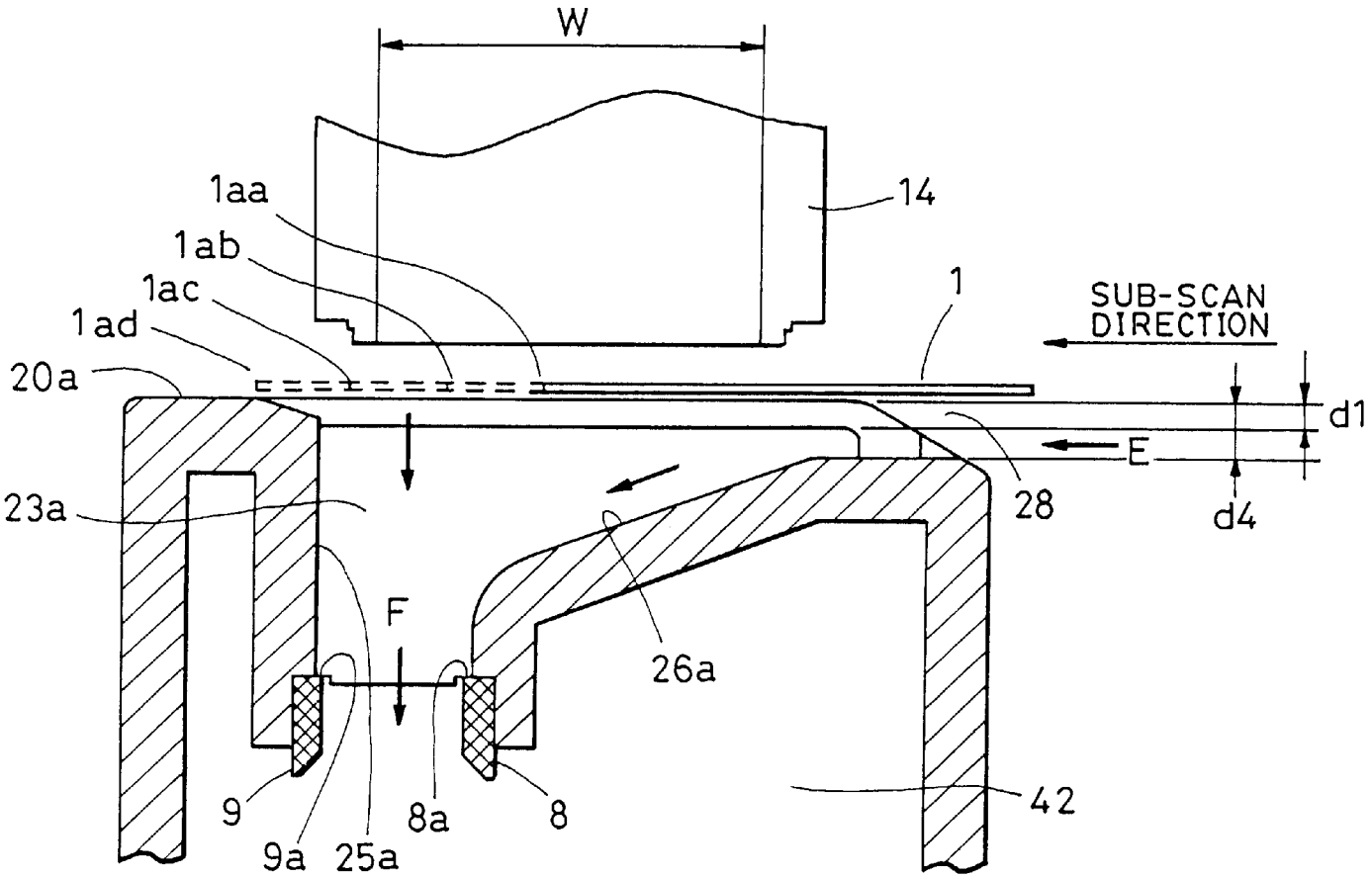
FIG. 8 is a sectional view taken along the line IIX—IIX in FIG. 7.
Figure 9:
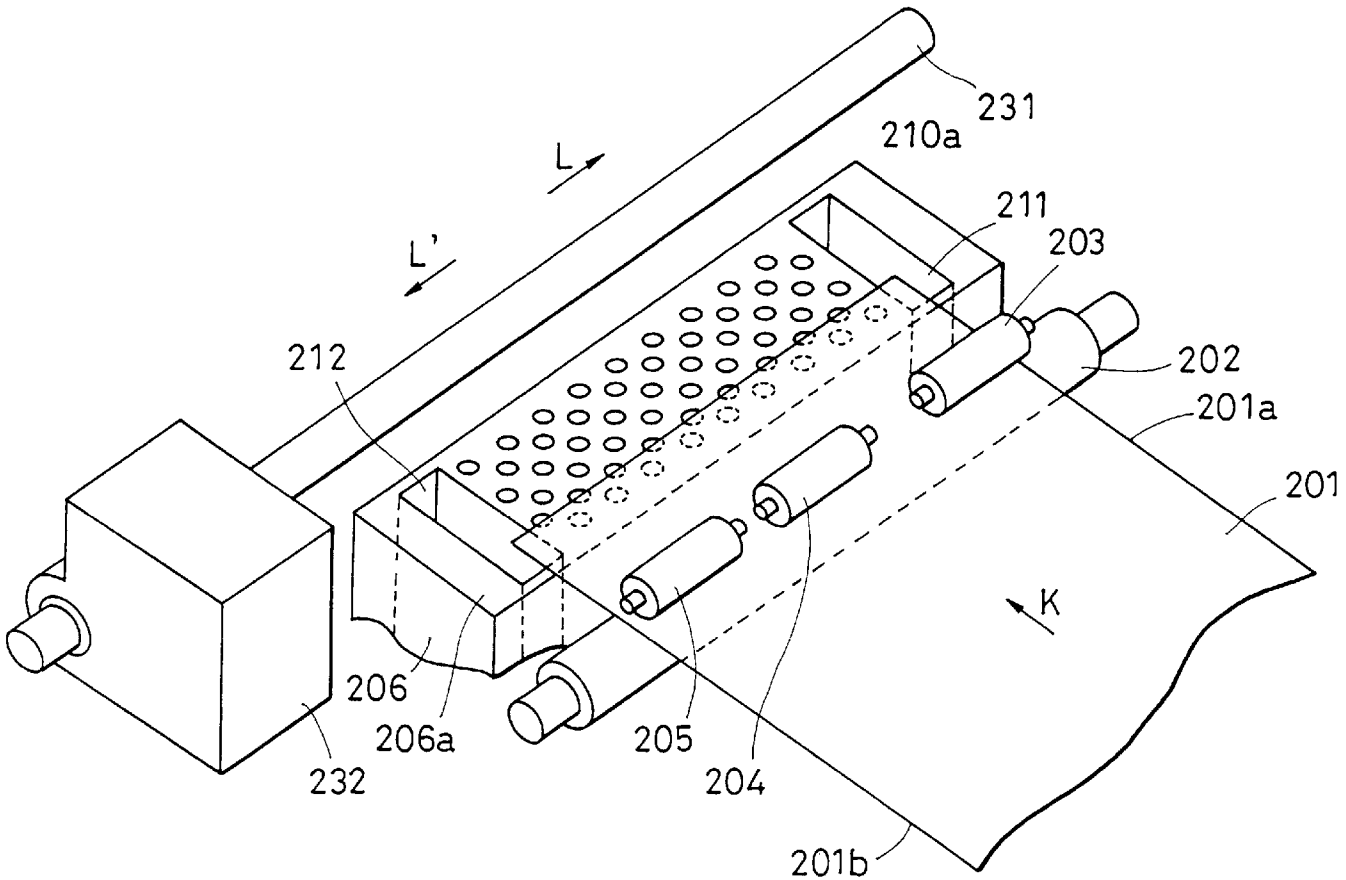
FIG. 9 is a perspective view of a platen and thereabout of a conventional recording apparatus.
Figure 10:
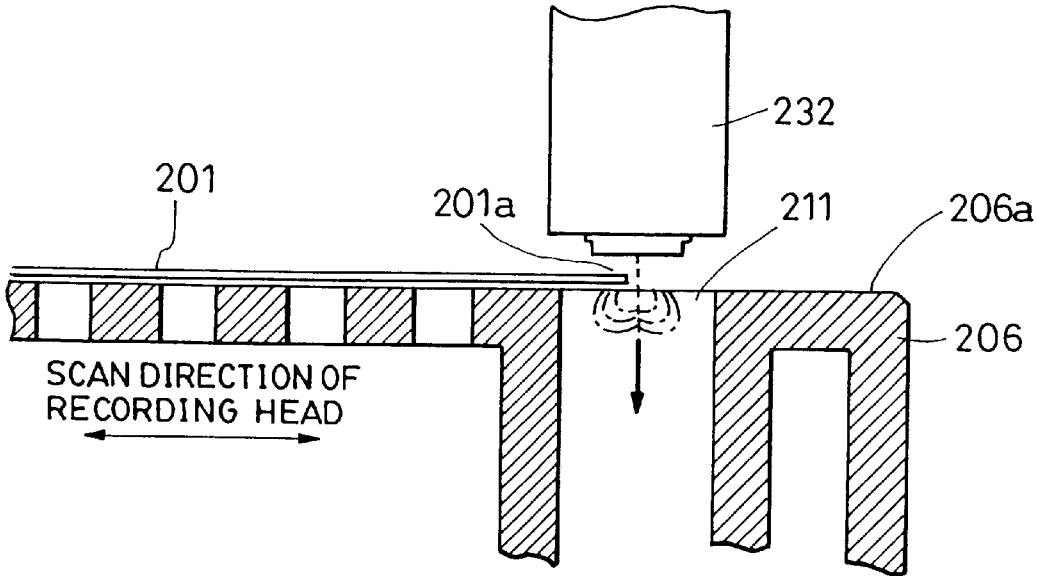
FIG. 10 is a sectional view for explaining a situation in which ink is ejected for frameless recording.

FIG. 8 is a sectional view taken along the line IIX—IIX in FIG. 7. At the position corresponding to each of the ends of the recording medium 1 in the width direction thereof, an inflow port 28 allowing air to flow into the ink recovery section 22 through the same is formed at one end of the platen 20 on the upstream side in the feed direction of the recording medium 1 such that the inflow port 28 is recessed by d4 from the guide surface 20*a*. Then, a sloped surface 26*a* is formed so as to gradually descend from the inflow port 28 toward the downstream side in the feed direction of the recording medium 1. The other end of the platen 20 on the downstream side in the feed direction of the recording medium 1 has the same height as the guide surface 20*a* of the platen 20; namely, it has such a shape as more closely restricting air inflow from the horizontal direction than at the one end of the platen 20 on the upstream side. Further, on the downstream side in the feed direction of the recording medium 1, a vertical wall surface 25*a* is provided to extend downwards from the platen surface 20*a* at a location corresponding to the position slightly downstream of the end of an ejection area W of the ink jet recording head 14. A thus-formed air stream passage is communicated with the common negative pressure chamber 42 at an opening defined by lower ends of both the wall surfaces 25*a,* 26*a*.

Air is guided to flow into the air stream passage through the inflow port 28 in the direction of arrow E, and then flows out in the direction of arrow F after joining with air having flown into the air stream passage from above. The other air flow passages 27*b,* 27*c* and 27*d* formed between the other thin plates 23 are each of the same configuration as described above. The ink recovery section 22 provided on the side corresponding to the other end 1*c* of the recording medium 1 also has a similar structure.

The above-described wall structure develops a stream baffling action based on the following reasons. A plurality of air stream passages are formed in a close side-by-side relation substantially parallel to each other to define a portion of a flow path extending from the air inlet side facing the ink jet recording head 14 to the common negative pressure chamber 42, and the length of each air stream passage in the direction of air stream is set to be greater than the length of at least one side of an opening section of each air stream passage on the air inlet side (i.e., the length of the opening section in the width direction of the recording medium, shown in FIG. 7, in this embodiment). Hence, there is no spatial allowance causing an air eddy to occur.

Thus, as shown in FIG. 8, when the recording medium 1 is fed to the guide surface 20*a* of the platen 20, a leading end 1*a* of the recording medium 1 intermittently fed by the feed roller 5 is first stopped at a position 1*aa* where the first cycle of recording is executed with one main scan of the carriage 11. Subsequently, the leading end 1*a* of the recording medium 1 is stopped at positions 1*ab,* 1*ac* where the recording scan is repeated. During that process, since the air stream passages 27*a,* 27*b,* 27*c* and 27*d* develop the stream baffling action upon air flowing into the ink recovery section 22 at each of the widthwise ends of the recording medium 1, an air eddy is prevented from occurring in upper portions of those air stream passages.

Also, one of the air stream passages, shown in FIG. 8, defined by the thin plate 23*a* in the ink recovery section 22 has the vertical wall surface 25*a* provided on the downstream side in the feed direction of the recording medium 1 at the position slightly downstream of the end of the ejection area W of the ink jet recording head 14, and also has the sloped surface 26*a* formed on the upstream side in the feed direction of the recording medium 1so as to gradually descend toward the downstream side in the feed direction of the recording medium 1. That air stream passage is communicated through a connecting opening at its lower end with the common negative pressure chamber 42.

At the leading end 1*a* of the recording medium 1, an air eddy occurs such that an ink mist from the ink jet recording head 14 tends to go around the leading end 1*a* of the recording medium 1 toward the backside thereof. However, since the connecting opening communicated with the common negative pressure chamber 42 is positioned at the lower end of the air stream passage, the air eddy is guided with air coming into the air stream passage through the inflow port 28 so as to smoothly flow from the leading end 1*a* side of the recording medium 1 to the left as viewed in FIG. 8. As a result, the air eddy hardly spreads to the backside of the recording medium 1. Even after the leading end 1*a* of the recording medium 1 is further advanced to completely cover the ink recovery section 22 with the progress of recording operation, most of air flows into the air stream passage through the inflow port 28 and then smoothly flows toward the common negative pressure chamber 42. It is therefore possible to suppress the occurrence of turbulence coming into the backside of the recording medium 1 beyond the uppermost ends of the thin plates 23*a,* 23*b*.

Further, since the height of the uppermost end of the thin plate 23*a* is set to be d1 lower than the guide surface 20*a* of the platen 20, the ink deposited on the uppermost end of the thin plate 23*a* is prevented from contacting the backside of the recording medium 1. Although smaller d1 is more effective in preventing the occurrence of an air eddy, a proper practical value of d1 is set in consideration of a fall of the recording medium 1 due to its own weight and curling. From experimental results, the value of d1 is preferably not larger than 1 mm. It is also preferable that each thin plate 23 is formed integrally with the platen 20 for improved dimensional stability.

Moreover, the ejected ink droplets and ink mists flow into the air stream passages, whose shapes are restricted as described above, together with the air streams and partly deposit on the wall surfaces 25*a,* 26*a*. The deposited ink droplets and ink mists move along those wall surfaces in the direction of gravity, but tend to accumulate at corners in section of each air stream passage due to a capillary phenomenon because the air stream passage has a small width. Such a drawback can be avoided by providing ink absorbers 8, 9 at the lower ends of the wall surfaces 25*a,* 26*a* such that each ink absorber is inserted in the air stream passages 27*a,* 27*b,* 27*c* and 27*d* as shown in FIG. 7. The ink absorbers 8, 9 are each formed of a foamed resin material, a felt-lie fibrous material or an absorptive polymer material. The ink absorbers 8, 9 have upper end portions 8*a,* 9*a,* shown in FIG. 8, which are located inside the air stream passages 27*a,* 27*b,* 27*c* and 27*d.* Also, lower end portions of the ink absorbers 8, 9 have sloped surfaces formed such that each ink absorber is gradually narrowed in section toward its lowermost end. In other words, the ink absorber has such a shape as allowing the ink absorbed therein to more easily drop downwards from the end of the sloped lower end portion as the ink absorber is saturated with the ink. Thus, the ink droplets deposited on the wall surfaces 25*a,* 26*a* drift downwards along those wall surfaces and are absorbed by the ink absorbers 8, 9. The absorbed ink then drops downwards as the ink absorbers are saturated with the ink. The dropped ink is recovered by providing ink recovery members, e.g., the ink absorbers 63, 64 shown in FIG. 4, at positions below the ink recovery sections.

Accordingly, even with the continued image recording, the accumulated ink droplets and ink mists can be prevented from impeding the air streams flowing through the air stream passages. Also, it is possible to prevent the accumulated ink droplets and ink mists from rising along the wall surfaces due to a capillary phenomenon and hence from staining the backside of the recording medium.

Further, by using an ink-repellent material, such as a fluorocarbon resin, to form the wall surfaces of the ink recovery section 22, the amount of ink held on the wall surfaces due to their own properties can be reduced, and the air streams flowing through the air stream passages can be less impeded. Using such a material is also effective in preventing a phenomenon that the deposited ink drifts over the wall surfaces against the gravity and spreads to the guide surface 20*a* of the platen 20. Hence, a backside smear of the recording medium 1 can be avoided.

Additionally, by finishing the wall surfaces of the ink recovery section 22 to be as smooth as possible, e.g., into a mirror finish, a similar effect as obtained with the ink repelling action can be resulted.

According to the embodiments, as described above, the ink jet recording apparatus comprises an ink recovery section for recovering ink ejected outside an end of a recording medium, a negative pressure generating unit for generating a pressure in the ink recovery section lower than the atmospheric pressure, and an air stream passage for communicating the ink recovery section and the negative pressure generating unit with each other. Therefore, the ink jet recording apparatus is able to perform high-quality recording without causing a backside smear of the recording medium even in frameless recording where an image is recorded in full size until reaching lengthwise and widthwise ends of the recording medium.

Also, according to the embodiments, the ink recovery section for recovering ink ejected outside the end of the recording medium includes an ink ejection area, the end of the recording medium, and an air stream baffling structure made up of thin plates having shapes and positional relationships determined so as to constitute air stream guiding passages. Therefore, the ink jet recording apparatus is able to perform high-quality recording without staining an upper guide surface of a platen and hence without causing a backside smear of the recording medium even in frameless recording where an image is recorded in full size until reaching lengthwise and widthwise ends of the recording medium.

Further, according to the embodiments, each of the air stream guiding passages in the ink recovery section has, in addition to an air inlet on the side adjacent to the recording medium, an inflow port positioned to allow air to flow into the air stream guiding passage in a direction substantially parallel to the platen guide surface along a lower surface of the recording medium opposite to a recording surface thereof. Therefore, the ink jet recording apparatus is able to suppress turbulence tending to flow across beyond uppermost ends of the air stream baffling plates and perform high-quality recording without causing a backside smear of the recording medium even in frameless recording where an image is recorded in full size until reaching lengthwise and widthwise ends of the recording medium.

Still further, according to the embodiments, ink absorbers capable of absorbing ink deposited on the air stream baffling plates are disposed between the air stream passages and associated communicating portions with the negative pressure generating unit. Therefore, the ink deposited on wall surfaces of the air stream passages is prevented from building up there, and air streams flowing the air stream passages are not impeded even when recording is continued for a long period of time. As a result, high-quality recording can be maintained without causing a backside smear of the recording medium.

Still further, according to the embodiments, the ink jet recording apparatus has a stream baffling structure provided corresponding to each of opposite ends of a recording medium to prevent the occurrence of turbulence caused in an ink sucking recovery port when the ends of the recording medium are subjected to an ink jet recording, and hence can avoid ink mists from going around to the backside of the recording medium.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet recording apparatus for ejecting ink from recording means to a recording medium to record an image, the apparatus comprising:

a platen having a guide surface for supporting the recording medium in a position opposed to said recording means;

an ink recovery section for recovering ink ejected outside an end of the recording medium;

negative pressure generating means for generating a pressure in said ink recovery section lower than the atmospheric pressure;

a communicating portion for communicating said ink recovery section and said negative pressure generating means with each other; and a stream baffling mechanism for guiding air streams flowing from the head side to the side of said negative pressure generating means, said stream baffling mechanism being provided in said ink recovery section.

2. An ink jet recording apparatus according to claim 1, wherein said stream baffling mechanism has a honeycomb structure in sectional shape on the side nearer to the head side.

3. An ink jet recording apparatus according to claim 1, wherein said ink recovery section is formed integrally with said platen.

4. An ink jet recording apparatus according to claim 1, wherein wall surfaces of said ink recovery section are treated to be ink-repellent.

5. An ink jet recording apparatus for ejecting ink from recording means to a recording medium to record an image, the apparatus comprising:

a platen having a guide surface for supporting the recording medium in a position opposed to said recording means;

an ink recovery section for recovering ink ejected outside an end of the recording medium;

negative pressure generating means for generating a pressure in said ink recovery section lower than the atmospheric pressure;

a communicating portion for communicating said ink recovery section and said negative pressure generating means with each other;

a thin plate provided in said ink recovery section; and a plurality of air stream passages provided in said ink recovery section, said plurality of air stream passages being partitioned by said thin plate.

6. An ink jet recording apparatus according to claim 5, wherein said ink recovery section further includes a stream baffling mechanism for guiding air streams flowing from the head side to the side of said negative pressure generating means.

7. An ink jet recording apparatus according to claim 5, wherein said plurality of air stream passages are each formed such that a length of each air stream passage in a direction of air stream is set to be greater than a length of at least one side of an opening section of each air stream passage on the air inlet side.

8. An ink jet recording apparatus according to claim 7, wherein ink absorbers are disposed in contact with wall surfaces of each of said air stream passages.

9. An ink jet recording apparatus according to claim 5, wherein said thin plate is provided in plural number.

10. An ink jet recording apparatus according to claim 9, wherein an end of each of the thin plates on the same side as the platen guide surface has a height lower than the guide surface of said platen.

11. An ink jet recording apparatus according to claim 9, wherein an end of each of the thin plates on the same side as the platen guide surface has a sloped shape.

12. An ink jet recording apparatus according to claim 9, wherein an end of each of the thin plates on the same side as the platen guide surface has a height lower than the guide surface of said platen and has a sloped shape.

13. An ink jet recording apparatus according to claim 9, wherein at least one of said air stream passages is positioned inside the end of said recording medium.

14. An ink jet recording apparatus according to claim 9, wherein one of the thin plates nearest to a central side of the apparatus is positioned inside the end of said recording medium.

15. An ink jet recording apparatus according to claim 14, wherein one of the thin plates nearest to the central side of the apparatus has a greater height on the side of said recording medium than the other thin plates.

16. An ink jet recording apparatus according to claim 9, wherein wall surfaces of said ink recovery section are treated to be ink-repellent.

17. An ink jet recording apparatus according to claim 5, wherein an end of said thin plate on the same side as the platen guide surface has a height lower than the guide surface of said platen.

18. An ink jet recording apparatus according to claim 5, wherein an end of said thin plate on the same side as the platen guide surface has a sloped shape.

19. An ink jet recording apparatus according to claim 5, wherein an end of said thin plate on the same side as the platen guide surface has a height lower than the guide surface of said platen and has a sloped shape.

20. An ink jet recording apparatus according to claim 5, wherein at least one of said air stream passages is positioned inside the end of said recording medium.

21. An ink jet recording apparatus according to claim 5, wherein ink absorbers are disposed in contact with wall surfaces of each of said air stream passages.

22. An ink jet recording apparatus according to claim 5, wherein wall surfaces of said ink recovery section are treated to be ink-repellent.

23. An ink jet recording apparatus for ejecting ink from recording means to a recording medium to record an image, the apparatus comprising:

a platen having a guide surface for supporting the recording medium in a position opposed to said recording means;

an ink recovery section for recovering ink ejected outside an end of the recording medium;

negative pressure generating means for generating a pressure in said ink recovery section lower than the atmospheric pressure;

a communicating opening for communicating air between said ink recovery section and said negative pressure generating means;

air stream passages for guiding air streams from the inlet side confronting the recording medium to said communicating opening by an air baffling mechanism made up of partitions arranged in said ink recovery section; and an inflow port allowing air to flow into each of the air stream passages in a direction substantially parallel to the guide surface of said platen.

24. An ink jet recording apparatus according to claim 23, wherein said communicating opening is arranged downstream of said inflow port in a feed direction of the recording medium.

25. An ink jet recording apparatus according to claim 23, wherein ink absorbers are disposed in contact with wall surfaces of each of said air stream passages.

26. An ink jet recording apparatus according to claim 23, wherein wall surfaces of said ink recovery section are treated to be ink-repellent.

27. An ink jet recording apparatus according to claim 23, wherein said recording means includes electro-thermal transducers for generating energy to eject ink.

* * * * *

UNITED STATES PATENT AND TRADEMARK OFFICE

CERTIFICATE OF CORRECTION

PATENT NO. : 6,575,554 B2
DATED : June 10, 2003
INVENTOR(S) : Yoshinaga

It is certified that error appears in the above-identified patent and that said Letters Patent is hereby corrected as shown below:

Drawings,
Sheet 3, FIG. 3, “RIRECTION” should read -- DIRECTION -- and “HEDIUM” should read -- MEDIUM --;
Sheet 5, FIGs. 5A and 5B, “HEDIUM” should read -- MEDIUM --.

Column 1,
Line 63, “direction,” should read -- direction --.

Column 2,
Line 38, “pent” should read -- tent --.

Column 4,
Line 46, “defines” should read -- define --.

Column 8,
Line 55, “no” should read -- an --.

Column 9,
Line 49, “section” should read -- sections --.

Column 12,
Line 25, “1so” should read -- 1 so --; and
Line 44, “of” should read -- of the --.

Column 13,
Line 1, “section” should read -- sections --.

Signed and Sealed this

Ninth Day of December, 2003

JAMES E. ROGAN
*Director of the United States Patent and Trademark Office*